US008258710B2

(12) United States Patent
Alexandrovich et al.

(10) Patent No.: US 8,258,710 B2
(45) Date of Patent: Sep. 4, 2012

(54) SOLID STATE LIGHT SOURCE DRIVING AND DIMMING USING AN AC VOLTAGE SOURCE

(75) Inventors: Benjamin Alexandrovich, Brookline, MA (US); David Betts, Peabody, MA (US)

(73) Assignee: Osram Sylvania Inc., Danvers, MA (US)

( * ) Notice: Subject to any disclaimer, the term of this patent is extended or adjusted under 35 U.S.C. 154(b) by 250 days.

(21) Appl. No.: 12/874,292

(22) Filed: Sep. 2, 2010

(65) Prior Publication Data

US 2012/0056554 A1 Mar. 8, 2012

(51) Int. Cl.
*H05B 37/00* (2006.01)

(52) U.S. Cl. ..... 315/207; 315/200 R; 315/119; 315/123; 315/125

(58) Field of Classification Search ..... 315/247, 315/119, 121, 123, 125, 200 R, 201–200 A, 315/185 S, 291, 307, 312
See application file for complete search history.

(56) References Cited

U.S. PATENT DOCUMENTS

2009/0303720 A1 12/2009 McGrath
2010/0308751 A1* 12/2010 Nerone ..... 315/312

FOREIGN PATENT DOCUMENTS

DE 202008004910 U1 6/2008
EP 1608206 A1 12/2005
EP 2048917 A1 4/2009

OTHER PUBLICATIONS

Ian Morrish, International Search Report and Written Opinion of the International Searching Authority, Jan. 20, 2012, pp. 1-9, European Patent Office, Rijswijk, The Netherlands.

* cited by examiner

*Primary Examiner* — Tuyet Thi Vo
(74) *Attorney, Agent, or Firm* — Shaun P. Montana

(57) ABSTRACT

Solid state light source driving and dimming systems are provided that enable a plurality of solid state light source (e.g., LED) driver circuits to be coupled to a single AC voltage source. The driver circuits may include constant current circuitry configured to generate a constant AC current from the AC voltage source, and rectifier circuitry configured to generate a DC current to drive the solid state light source (e.g., LEDs). Dimming control includes shunt circuitry operable with a PWM switch to shunt the AC voltage source during certain portions of a PWM signal and to decouple the shunt circuitry from the AC voltage source during other portions of the PWM signal. Shunting the AC voltage source causes the interruption of the DC current to effectively turn off the LEDs. Decoupling the shunt circuitry may improve overall efficiency of power transfer to the LEDs.

20 Claims, 5 Drawing Sheets

SOLID STATE LIGHT SOURCE DRIVING AND DIMMING USING AN AC VOLTAGE SOURCE

TECHNICAL FIELD

The present application relates to driving and dimming solid state light sources using an AC voltage source, and more particularly, to driving multiple solid state light source strings using an AC voltage source.

BACKGROUND

Conventional driving systems for solid state light sources, such as but not limited to light emitting diodes (LEDs), typically utilize DC/DC converter circuits to generate a constant DC current to drive the LEDs. Power to a DC/DC converter is typically supplied from an AC voltage source.

SUMMARY

Conventional driving systems for solid state light sources, such as those described above, while typically offering stable drive current, unnecessarily increase electronic component count. This may degrade the efficiency of power transfer to the LEDs. In addition, these conventional driving systems are typically ill-suited to supply power to a plurality of LED strings, since there is no guarantee that the individual channels will remain isolated and/or grounded (non-floating) during operation.

In an embodiment, there is provided a solid state light source driving and dimming system. The solid state light source driving and dimming system includes a plurality of solid state light source driver circuits configured to be coupled to an AC voltage source. Each driver circuit includes: a constant current circuitry coupled to the AC voltage source, wherein the constant current circuitry is configured to generate a constant AC current from the AC voltage source; rectifier circuitry coupled to the constant current circuitry and configured to generate a DC current to drive at least one solid state light source; shunt circuitry coupled to a negative voltage rail and a positive voltage rail of the AC voltage source; switch circuitry coupled to the shunt circuitry; and pulse width modulation (PWM) circuitry configured to generate a PWM signal to control a conduction station of the switch circuitry; wherein when the switch circuitry is closed, a conduction path exists between the AC voltage source and the shunt circuitry through the switch circuitry to discontinue the DC current, and when the switch circuitry is closed, the shunt circuitry is electrically decoupled from the AC voltage source.

In a related embodiment, the constant current circuitry may include a ballast capacitor coupled to the positive rail of the AC voltage source. In another related embodiment, the shunt circuitry may include a first diode coupled to the positive voltage rail and in forward bias toward the switch; and a second diode coupled to the negative voltage rail and in forward bias toward the switch; wherein when the switch is closed, the AC voltage source may be shunted through the first and second diodes to discontinue the DC current to the at least one solid state light source.

In yet another related embodiment, the shunt circuitry may include a first diode coupled to the negative voltage rail and in forward bias toward the positive voltage rail; a second diode coupled to the first diode and the positive voltage rail and in forward bias toward the switch; and a third diode coupled to the negative voltage rail and in forward bias toward the switch; wherein when the switch is closed, the AC voltage source may be shunted through the first, second and third diodes to discontinue the DC current to the at least one solid state light source.

In still another related embodiment, the rectifier circuitry may include full wave bridge rectifier circuitry configured to generate a full wave rectified AC current from the AC current and a filtering capacitor in parallel with the at least one solid state light source; and wherein the filtering capacitor may be configured to filter the full wave rectified AC current into the DC current to drive the at least one solid state light source.

In yet still another related embodiment, the rectifier circuitry may include three diodes configured to generate a rectified AC current from the AC current and a filtering capacitor in parallel with the at least one solid state light source; and wherein the filtering capacitor may be configured to filter the rectified AC current into the DC current to drive the at least one solid state light source. In still yet another related embodiment, the solid state light source driving and dimming system may further include a return diode shared by the driver circuits, wherein the return diode may be coupled to the switch and the shunt circuitry and in forward bias toward the negative voltage rail; wherein when the switch is closed, the return diode may provide a current path from the positive voltage rail, through the shunt circuitry and the switch and to the negative voltage rail.

In yet still another related embodiment, the solid state light source driving and dimming system may further include first and second return diodes shared by the driver circuits, wherein the first return diode may be coupled to the switch and the shunt circuitry and in forward bias toward the negative voltage rail, and the second return diode may be coupled to the rectifier circuitry and the solid state light source and in forward bias toward the negative voltage rail; and wherein when the switch is closed, the first return diode may provide a current path from the positive voltage rail, through the shunt circuitry and the switch and to the negative voltage rail, and wherein when the switch is opened, the second return diode may provide a current path from the solid state light source to the negative voltage rail.

In still yet another related embodiment, the switch circuitry and the PWM circuitry may be coupled to a common ground. In yet still another embodiment, the rectifier circuitry and the at least one solid state light source may be coupled to a common ground. In still another related embodiment, the switch circuitry, the PWM circuitry, the rectifier circuitry and the at least one solid state light source may be coupled to a common ground.

In yet another related embodiment, each driver circuit may further include isolation circuitry coupled to a negative voltage rail of the AC current source and configured to electrically isolate each driver circuit from each other. In still another related embodiment, the solid state light source driving and dimming system may further include an isolation transformer having a primary winding and a plurality of secondary windings, wherein the primary winding may be coupled to the AC voltage source and each driver circuit may be coupled to a respective secondary winding, and wherein the isolation transformer may be configured to electrically isolate each driver circuit from each other.

In another embodiment, there is provided a solid state light source driving and dimming system. The solid state light source driving and dimming system includes: a plurality of solid state light source driver circuits configured to be coupled to an AC voltage source, each driver circuit including: constant current circuitry coupled to an AC voltage source, the constant current circuitry is configured to generate a constant AC current from the AC voltage source; isolation circuitry coupled to the AC voltage source and configured to electrically isolate each driver circuit from each other; rectifier circuitry coupled to the constant current circuitry and configured to generate a DC current to drive at least one solid state light source; shunt circuitry coupled to a negative and positive voltage rails of the AC voltage source; switch circuitry coupled to the shunt circuitry; and pulse width modulation (PWM) circuitry configured to generate a PWM signal to control a conduction station of the switch circuitry; wherein when the switch circuitry is closed, a conduction path exists between the AC voltage source and the shunt circuitry through the switch circuitry to discontinue the DC current, and when the switch circuitry is closed, the shunt circuitry is electrically decoupled from the AC voltage source.

In a related embodiment, the shunt circuitry may include: a first diode coupled to the negative voltage rail and in forward bias toward the positive voltage rail; a second diode coupled to the first diode and the positive voltage rail and in forward bias toward the switch; and a third diode coupled to the negative voltage rail and in forward bias toward the switch; wherein when the switch is closed, the AC voltage source may be shunted through the first, second and third diodes to discontinue the DC current to the at least one solid state light source.

In another related embodiment, the isolation circuitry may include a capacitor coupled to the negative voltage rail and the constant current circuitry may include a capacitor coupled to the positive voltage rail, and wherein the capacitance of the isolation circuitry and the constant current circuitry may be approximately equal. In yet another related embodiment, the switch circuitry, the PWM circuitry, the rectifier circuitry and the at least one solid state light source may be coupled to a common ground.

In another embodiment, there is provided a solid state light source driving and dimming system. The solid state light source driving and dimming system includes: an isolation transformer having a primary winding coupled to an AC voltage source and a plurality of secondary windings, wherein the isolation transformer is configured to electrically isolate each respective secondary winding from each other; a plurality of solid state light source driver circuits configured to be coupled to a respective secondary winding, each driver circuit including: constant current circuitry coupled to a secondary winding, the constant current circuitry is configured to generate a constant AC current from the AC voltage source; rectifier circuitry coupled to the constant current circuitry and configured to generate a DC current to drive at least one solid state light source; shunt circuitry coupled to a negative and positive voltage rails of the secondary winding; switch circuitry coupled to the shunt circuitry; and pulse width modulation (PWM) circuitry configured to generate a PWM signal to control a conduction station of the switch circuitry; wherein when the switch circuitry is closed, a conduction path exists between the secondary winding and the shunt circuitry through the switch circuitry to discontinue the DC current, and when the switch circuitry is closed, the shunt circuitry is electrically decoupled from the secondary winding.

In a related embodiment, the shunt circuitry may include: a first diode coupled to the negative voltage rail and in forward bias toward the positive voltage rail; a second diode coupled to the first diode and the positive voltage rail and in forward bias toward the switch; and a third diode coupled to the negative voltage rail and in forward bias toward the switch; wherein when the switch is closed, the secondary winding may be shunted through the first, second and third diodes to discontinue the DC current to the at least one solid state light source. In another related embodiment, the switch circuitry, the PWM circuitry, the rectifier circuitry and the at least one solid state light source may be coupled to a common ground.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION

Embodiments described herein concern driving and dimming solid state light sources, such as but not limited to light emitting diode (LED) strings. Solid state light sources may include, in addition to LEDs and among other things, organic LEDs (OLEDs), as well as other LED-based light sources. The drive current for an LED string may be derived, for example, from a conventional AC power source and/or an instant start ballast conventionally used to drive one or more linear fluorescent lamps. Thus, embodiments disclosed herein may be used as a direct retrofit to replace conventional fluorescent lamps with LED-based lightning, and in some embodiments, the need for DC/DC converter circuitry may be eliminated. PWM dimming techniques may be employed to control the brightness and/or color of individual LED strings. Advantageously, embodiments disclosed herein may offer reduced component count which may translate to increased power factor efficiency and significant cost savings over conventional LED driving systems.

Figure 1:
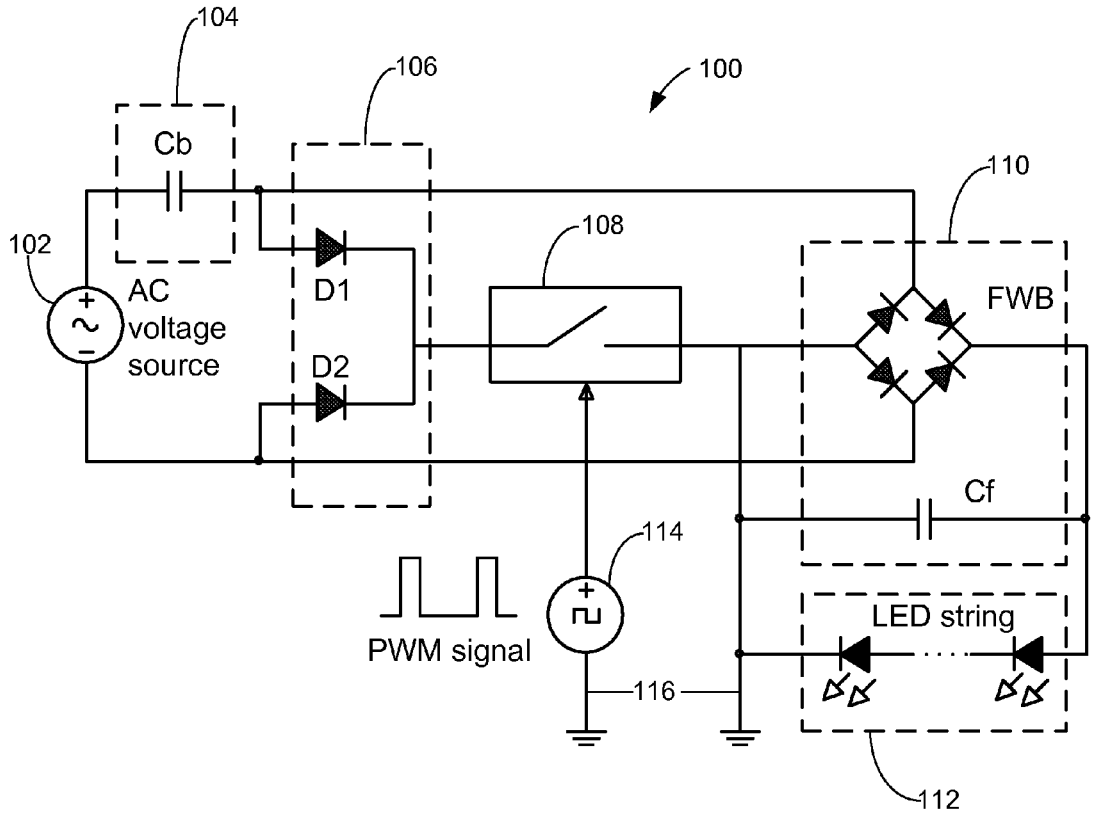
FIG. 1 is a circuit diagram of one exemplary LED driver system consistent with one embodiment of the present disclosure.

FIG. 1 is a circuit diagram of a solid state light source driver system 100 according to embodiments described herein. In FIG. 1, the solid state light sources are a string of LEDs. The solid state light source driver system 100 includes an AC voltage source 102, current source circuitry 104, rectifier circuitry 110, and an LED string 112. The AC voltage source 102 is configured to generate an AC voltage, for example but not limited to, a sinusoidal AC voltage. Alternatively or additionally, the AC voltage source 102 may be a ballast source associated with a gas discharge lamp fixture, and may thus be configured to supply voltage in the range of 600 VAC operating at 20 to 200 KHz, depending on the type of gas discharge lamp conventionally used. Of course, these are only examples of the types of voltage sources that may be utilized herein, and those skilled in the art will recognize that other voltage sources may be used without departing from the scope of embodiments described herein. Since the drive current required by a typical LED string is much less that may be generated by the AC voltage source 102, embodiments may also include the current source circuitry 104 coupled to one or more voltage rails of the AC voltage source 102 and configured to generate a current from the AC voltage source 102. In this example, the current source circuitry 104 may include a ballast capacitor Cb that is configured to generate a constant AC current and is coupled to the positive voltage rail of the AC voltage source 102 and in series with the LED string 112, which is the load. The capacitance value of the ballast capacitor Cb may be selected based on the operating frequency of the AC voltage source 102, and may be generally given by the equation $Cb=I/2\pi fV$, where I is the output current of the ballast capacitor Cb, V is the voltage of the AC voltage source 102, and f is the frequency of the AC voltage source 102.

The rectifier circuitry 110 may be coupled to the current source circuitry 104 and configured to rectify and filter the AC current generated by the current source circuitry 104. In some embodiments, and as shown in FIG. 1, the rectifier circuitry 110 may include full wave bridge circuitry (FWB) that includes four diodes arranged to rectify the AC current into a full wave rectified AC current. This arrangement is also known as a full wave rectifier, and may be referred to herein as either a full wave bridge, FWB or full wave rectifier. A filter capacitor Cf may be provided to filter the rectified AC current and generate a DC or quasi-DC current. The LED string 112 may be coupled to the rectifier circuitry 110. In some embodiments, the LED string 112 may include a plurality of LED and/or other solid state light source devices configured to emit light. The LED string 112 may be driven by the DC current generated by the rectifier circuitry 110. While the filter capacitor Cf may smooth the rectified DC current into a DC or quasi-DC signal, such a smoothed signal may still produce significant DC variations in relation to the peak-to-trough values of the AC current. Thus, to reduce or eliminate perceptible flicker due to the incomplete smoothing effect of the filter capacitor Cf, the capacitance value of Cf may be selected to have a large enough time constant, based on, for example but not limited to, the operating frequency of the AC voltage source 102 and required supply LED current. In FIG. 1, the ballast capacitor Cb may be much smaller than the filter capacitor Cf, for example, by orders of magnitude. The LED string 112 may be coupled to a ground 116, which may include, for example, a system MAINS ground and/or common (earth) ground. Coupling the LED string 112 to the ground 116 may reduce or eliminate the LED string 112 from being in a "floating" state, which may reduce or eliminate electro-magnetic interference emanated by the LED string 112.

The solid state light source driver system 100 shown in FIG. 1 may also be configured for pulse width modulated (PWM) dimming to provide dimming control over the LED string 112. To that end, the solid state light source driver system 100 may, in some embodiments, include shunt circuitry 106 and dimming circuitry that includes a switch 108 and a PWM signal source 114. In such embodiments, the shunt circuitry 106 may include two diodes D1 and D2 coupled to respective rails of the AC voltage source 102 and forward biased into the switch 108. The shunt circuitry 106 is configured to shunt the AC voltage source 102 depending on the conduction state of the switch 108, as will be described below. The switch 108 may be operably coupled to the shunt circuitry 106 and the FWB circuitry in the rectifier circuitry 110. In operation, the PWM signal source 114 is configured to generate a PWM signal to control the conduction state of the switch 108. When the PWM signal is ON (high), the switch 108 may close, thus creating a conduction path through the switch 108. During the positive half wave of a signal from the AC voltage source 102, current may flow through the diode D1, through the switch 108, through a lower left diode of the FWB circuitry, and back to the AC voltage source 102. During the negative half wave of the signal from the AC voltage source 102, current may flow through the diode D2, through the switch 108, through the upper left diode of FWB circuitry, and back to the AC voltage source 102. Thus, when the switch 108 is conducting, the AC voltage source 102 may be shunted to interrupt current flow to the LED string 112.

When the PWM signal is OFF, the switch 108 may open, thus decoupling the shunt circuitry 106 and the switch 108 from the AC voltage source 102. In that case, during a positive half wave of a signal from the AC voltage source 102, current flows through the upper right diode of the full wave rectifier FWB, through the LED string 112, through the lower left diode of the FWB and back to the AC voltage source 102. During a negative half wave of the signal from the AC voltage source 102, current flows through the lower right diode of the FWB, through the LED string 112, through the upper left diode of the FWB and back to the AC voltage source 102. Decoupling the shunt circuitry 106, such that there no power loss on the elements in the shunt circuitry 106, when power is delivered to the LED string 112, may offer significant efficiency and power factor enhancements and may further operate to increase a signal to noise ratio of power delivered to the LED string 112.

In some embodiments, the filter capacitor Cf may have a capacitance value that enables the filter capacitor Cf to still deliver energy to the LED strings 112 when the AC voltage source 102 is shunted, but also to de-energize quickly enough to allow for adequate dimming control using the duty cycle of the PWM signal generated by the PWM signal source 114. Thus, for example, the filter capacitor Cf may have a value that allows it to drain energy to the LED string 112 within a few percent of the ON time of the switch 108. The PWM signal source 114 may be coupled to the ground 116, which may include, for example, a system MAINS ground and/or common (earth) ground. Coupling the PWM signal source 114 to the ground 116 may reduce or eliminate the PWM signal source 114 from being in a "floating" state, which may reduce or eliminate harmonic noise in the switch 108 and shunt circuitry 106 and enable finer control over the LED string 112. While the switch 108 is depicted as a generalized switching circuit, those skilled in the art will recognize that the switch 108 may include a FET switch, BJT switch or other electronic circuit capable of switching conduction states. As is known, the PWM signal generated by the PWM signal source 114 may have a controllable duty cycle to control the brightness and/or color of the LED string 112. For example, assuming a 50% duty cycle, drive current is delivered to LED string 112 during the OFF time of the switch 108 and interrupted during the ON time of the switch 108. To control the overall brightness in the LED string 112, the duty cycle of the PWM signal may be adjusted. For example, the duty cycle may range from 0% (the switch 108 is always open) to 100% (the switch 108 is always closed) to control the overall brightness (luminosity) and/or color of the LED string 112.

Figure 2:
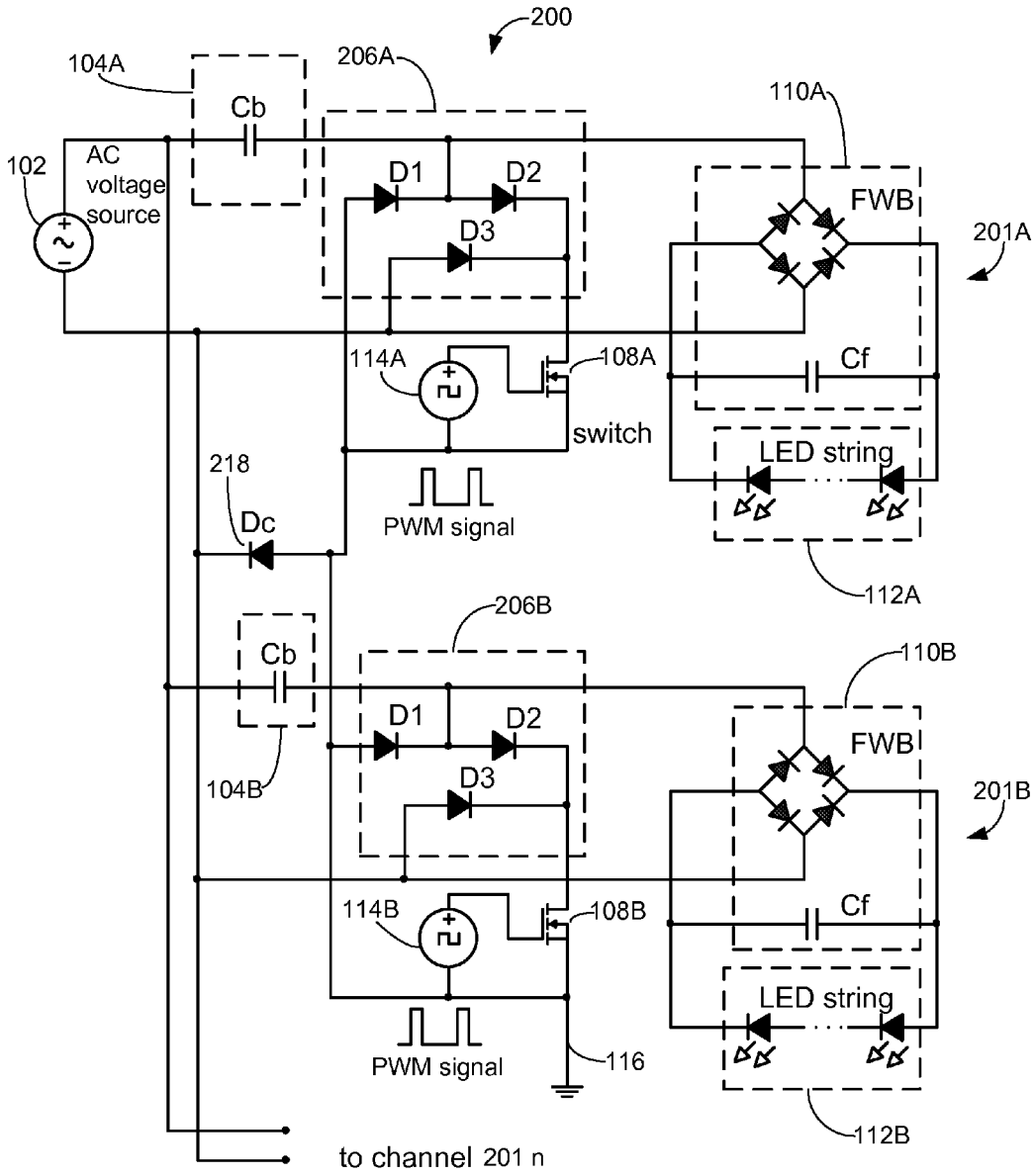
FIG. 2 is a circuit diagram of another exemplary LED driver system consistent with one embodiment of the present disclosure.

FIG. 2 shows a solid state light source driver system 200 according to embodiments described herein. The solid state light source driver system 200 is configured to drive a plurality of LED strings 112A, 112B, . . . , 112*n* from a single AC voltage source 102, and includes a plurality of LED driver circuits 201A, 201B, . . . , 201*n*. An AC voltage source 102 is coupled to each of the LED driver circuits 201A, 201B, . . . , 201*n*, each of which, in whole or in part, may represent an LED channel, and the LED driver circuits 201A, 201B, . . . , 201*n*, each as a whole or in part thereof, may be referred to herein as a "channel", and vice versa. Each of the LED driver circuits 201A, 201B, . . . , 201*n* have a similar topology and operate in a similar manner as the circuit shown in FIG. 1, except as described below. Each LED driver circuit 201A, 201B, . . . , 201*n* may include respective current source circuitry 104A, 104B, . . . , 104*n*, a respective switch 108A, 108B, . . . , 108*n*, respective PWM signal source circuitry 114A, 114B, . . . , 114*n*, respective rectifier circuitry 110A, 110B, . . . , 110*n* and a respective LED string 112A, 112B, . . . , 112*n*. Here, the designation A, B, . . . , N in connection with reference numerals should be interpreted as a repetition of like components. The description and operation of these components are described above with reference to FIG. 1.

Each LED driver circuit 201A, 201B, . . . , 201*n* may also include respective shunt circuitry 206A, 206B, . . . , 206*n*. Each respective shunt circuitry 106A, 106B, . . . , 106*n* may include three diodes D1, D2 and D3, where the diodes D1 and D3 are coupled to the negative rail of the AC voltage source 102 and forward biased into the respective switch 108, and the diode D2 is coupled to the positive rail of the AC voltage source 102 and forward biased into the respective switch 108. The shunt circuitry 206A, 206B, . . . , 206*n* is configured to independently shunt the AC voltage source 102 depending on the conduction state of the respective switch 108A, 108B, . . . , 108*n*, as will be described below. Embodiments may also include a return diode (Dc) 218 that is shared by each of the driver circuits 201A, 201B, . . . , 201*n* and coupled to each respective shunt circuitry 206A, 206B, . . . , 206*n* and switch 108A, 108B, . . . , 108*n*. Each switch 108A, 108B, . . . , 108*n* may be operably coupled to respective shunt circuitry 106A, 106B, . . . , 106*n* and the return diode 218.

In operation, each respective PWM signal source circuitry 114A, 114B, . . . , 114*n* is configured to generate a PWM signal to control the conduction state of a respective switch 108A, 108B, . . . 108*n*. Using the driver circuit 201A as an example, when the PWM signal is ON (high), the switch 108A may conduct, thus closing the switch 108A. During the positive half wave of a signal from the AC voltage source 102, current may flow through the diode D2, through the switch 108A, through the return diode 218, and back to the AC voltage source 102. During the negative half wave of a signal from the AC source 102, current may flow through the diode D3, through the switch 108A, through the diode D1, and back to the AC voltage source 102. Thus, when the switch 108A is conducting, the AC voltage source 102 may be shunted to interrupt current flow to the LED string 112A. When the PWM signal is OFF (low), the switch 108A may open, thus decoupling the shunt circuitry 206A from the AC voltage source 102. In that case, current flows through the rectifier circuitry 110A to power the LED string 112A, as described above in regards to FIG. 1. Decoupling the shunt circuitry 206A, such that there is no power loss on the elements in the shunt circuitry 206A when power is delivered to the LED string 112A, may offer significant power factor enhancements and may further operate to increase a signal to noise ratio of power delivered to the LED string 112A. Each of the other driver circuits 201B, . . . , 201*n* may, and in some embodiments do, operate in a similar manner.

Each LED string 112A, 112B, . . . , 112*n* may include one or more individual LED devices. Each string may be arranged by color, for example but not limited to a red, green, blue (RGB) topology in which the LED string 112A may include one or more red LEDs, the LED string 112B may include one or more green LEDs, and the LED string 112*n* may include one or more blue LEDs. Of course, this is only an example and other color arrangements are equally contemplated herein, for example, RGW (red, green, white), RGBY (red, green, blue, yellow), infrared, etc., without departing from the scope of the embodiments described herein. By controlling the brightness in each LED string 112A, 112B, . . . , 112*n*, the overall brightness and/or perceived color of the collection of the LED strings 112A, 112B, . . . , 112*n* may be controlled. Thus, in such embodiments, each PWM signal source 114A, 114B, . . . , 114*n* may be independently controlled with its own duty cycle to independently control each LED string 112A, 112B, . . . , 112*n*. To that end, the return diode 218 may operate to reduce or eliminate crosstalk between each driver circuit 201A, 201B, . . . , 201*n*, i.e., reduce or eliminate the effect of varying current between LED strings 112A, 112B, . . . , 112*n*.

In embodiments as shown in FIG. 2, the PWM signal source circuitry 114B may be coupled to a ground 116, which may include, for example, a system MAINS ground and/or common (earth) ground. Coupling the PWM signal source circuitry 114B to the ground 116 may reduce or eliminate the PWM signal source circuitry 114B from being in a "floating" state, which may reduce or eliminate harmonic noise in the respective switch 108B and the respective shunt circuitry 206B and enable finer control over the LED string 112B. However, in such embodiments, each LED string 112A, 112B, . . . , 112*n* may not be coupled to a ground (due to potential shorting issues), and thus, the LED strings 112A, 112B, . . . , 112*n* may be in a floating condition which could introduce noise and/or other non-controllable factors into the solid state light source driving system 200.

Figure 3:
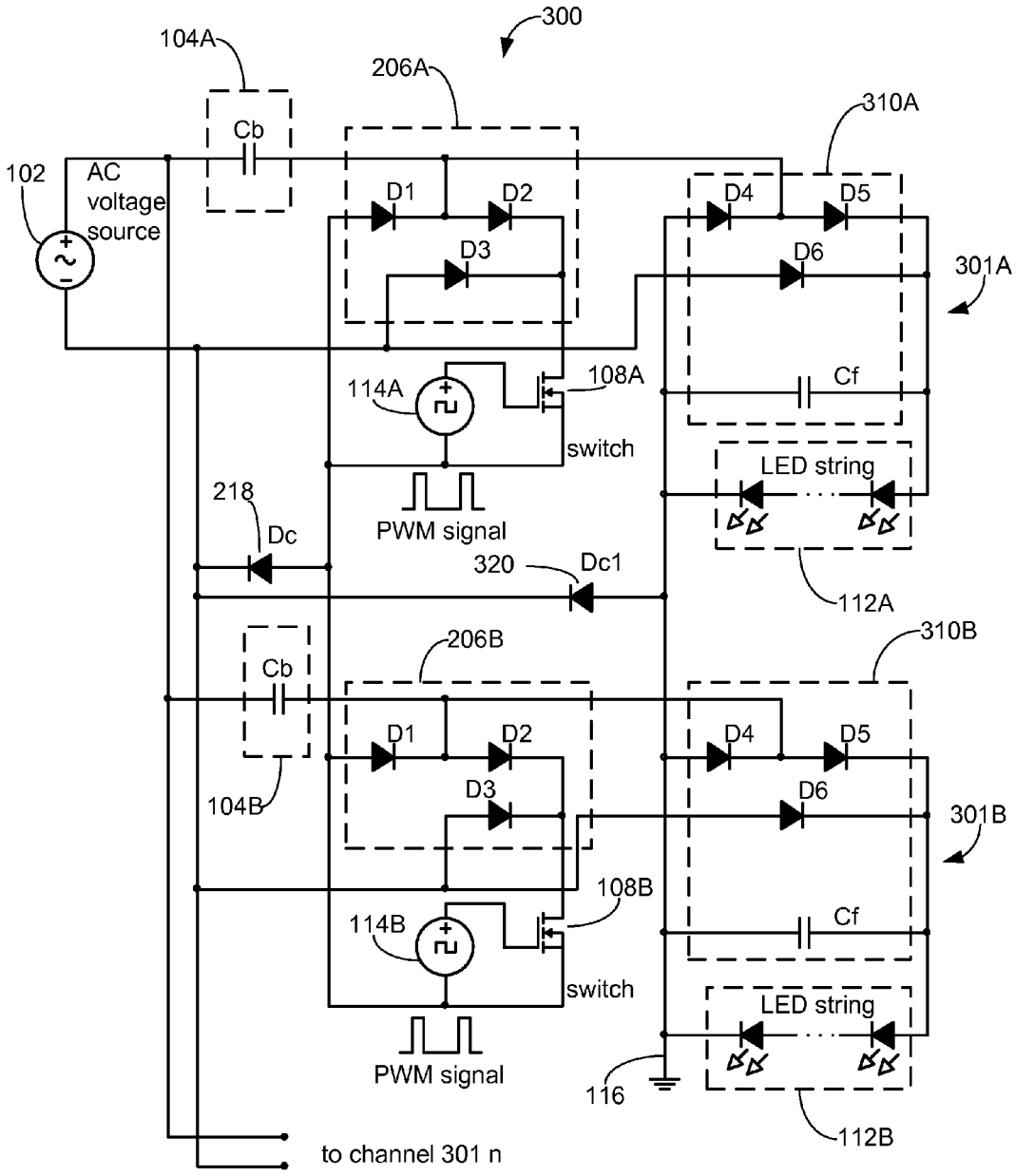
FIG. 3 is a circuit diagram of another exemplary LED driver system consistent with one embodiment of the present disclosure.

FIG. 3 shows a solid state light source driver system 300 according to embodiments described herein, which are configured to drive a plurality of LED strings 112A, 112B, . . . , 112*n* from a single AC voltage source, similar to the embodiment of FIG. 2. Here, a plurality of LED driver circuits 301A, 301B, . . . , 301*n* are each coupled to an AC voltage source 102. Each of the LED driver circuits 301A, 301B, . . . , 301*n* have a similar topology and operate in a similar manner as the system 100 shown in FIG. 1, except as described below. Each LED driver circuit 301A, 301B, . . . , 301*n* may include respective current source circuitry 104A, 104B, . . . , 104*n*, a respective switch 108A, 108B, . . . , 108*n*, respective PWM signal source circuitry 114A, 114B, . . . , 114*n*, respective shunt circuitry 206A, 206B, . . . , 206*n*, and respective LED strings 112A, 112B, . . . , 112*n*. Here, the designation A, B, . . . , N in connection with reference numerals should be interpreted as a repetition of like components. The description and operation of these components are described above with reference to FIGS. 1 and 2.

Embodiments may also include first and second return diodes (Dc and Dc1) 218 and 320 that are shared by each of the LED driver circuits 301A, 301B, . . . , 301*n*. The first return diode 218 may be coupled to each respective shunt circuitry 206A, 206B, . . . , 206*n* and each respective switch 108A, 108B, . . . , 108*n*. The second return diode 320 may be coupled to each respective LED string 112A, 112B, . . . , 112*n* and each respective rectifier circuitry 310A, 310B, . . . , 310*n*. Each switch 108A, 108B, . . . , 108*n* may be operably coupled to the respective shunt circuitry 206A, 206B, . . . , 206*n* and the first return diode 218. The rectifier circuitry 310A, 310B, . . . , 310*n* may include three diodes D4, D5 and D6 instead of the FWB topology that comprises four diodes as shown in FIGS. 1 and 2.

In operation, each respective PWM signal source circuitry 114A, 114B, . . . , 114*n* is configured to generate a PWM signal to control the conduction state of a respective switch 108A, 108B, . . . 108*n*. Using the LED driver circuit 301A as an example, when the PWM signal is ON (high), the switch 108A may close, creating a conduction path through the switch 108A. During the positive half wave of a signal from the AC voltage source 102, current may flow through the diode D2, through the switch 108A, through the first return diode 218, and back to the AC voltage source 102. During the negative half wave of a signal from the AC voltage source 102, current may flow through the diode D3, through the switch 108A, through the diode D1, and back to the AC voltage source 102. Thus, when the switch 108A is conducting, the AC voltage source 102 may be shunted to interrupt current flow to the LED string 112A. When the PWM signal is OFF (low), the switch 108A may open, thus decoupling the shunt circuitry 106A from the AC voltage source 102. In that case, during the positive half wave of a signal from the AC voltage source 102, current may flow through the diode D5, through the LED string 112A, through the second return diode 320, and back to the AC voltage source 102. During the negative half wave of a signal from the AC voltage source 102, current may flow through the diode D6, through the LED string 112A, through the diode D4, and back to the AC voltage source 102. As with previously described embodiments, decoupling the shunt circuitry 206A, such that there is no power loss on the elements in the shunt circuitry 206A, when power is delivered to the LED string 112A, may offer significant power factor enhancements and may further operate to increase a signal to noise ratio of power delivered to the LED string 112A. Each of the other LED driver circuits 301B, . . . , 301*n* may operate in a similar manner.

As with the previous described embodiments, each LED string 112A, 112B, . . . , 112*n* may include one or more individual LED devices. Each LED string 112A, 112B, . . . , 112*n* may be arranged by color, for example a red, green, blue (RGB) topology in which the LED string 112A may include one or more red LEDs, the LED string 112B may include one or more green LEDs, and the LED string 112*n* may include one or more blue LEDs. Of course, this is only an example, and other color arrangements are equally contemplated herein, for example, RGW (red, green, white), RGBY (red, green, blue, yellow), infrared, etc., without departing from the scope of embodiments described herein. By controlling the brightness in each LED string 112A, 112B, . . . , 112*n*, the overall brightness and/or perceived color of the collection of LED strings 112A, 112B, . . . , 112*n* may be controlled. Thus, in such embodiments, each PWM signal source circuitry 114A, 114B, . . . , 114*n* may be independently controlled with its own duty cycle to independently control each LED string 112A, 112B, . . . , 112*n*. To that end, the first and second return diodes 218 and 320 may operate to reduce or eliminate crosstalk between each LED driver circuit 301A, 301B, . . . , 301*n*, i.e., reduce or eliminate the effect of varying current between the LED strings 112A, 112B, . . . , 112*n*.

Advantageously, in such embodiments, elimination of one of the diodes in each of the respective rectifier circuitry 310A, 310B, . . . , 310*n* may enable the rectifier circuitry 310A, 310B, . . . , 310*n* and the LED string 112A, 112B, . . . , 112*n* in each LED driver circuit 301A, 301B, . . . , 301*n* to be coupled to a ground 116. Such an arrangement may reduce or eliminate noise and/or reduce electro-magnetic interference emanated by the LED string 112A, 112B, . . . , 112*n* and other non-controllable factors into the system 300. However, in this arrangement, the PWM signal source circuitry 114A, 114B, . . . , 114*n* may not be coupled to a ground due to potential shorting issues, and thus, the PWM signal source circuitry 114A, 114B, . . . , 114*n* may be in a floating condition, which could introduce noise and/or other non-controllable factors into the system 300.

Figure 4:
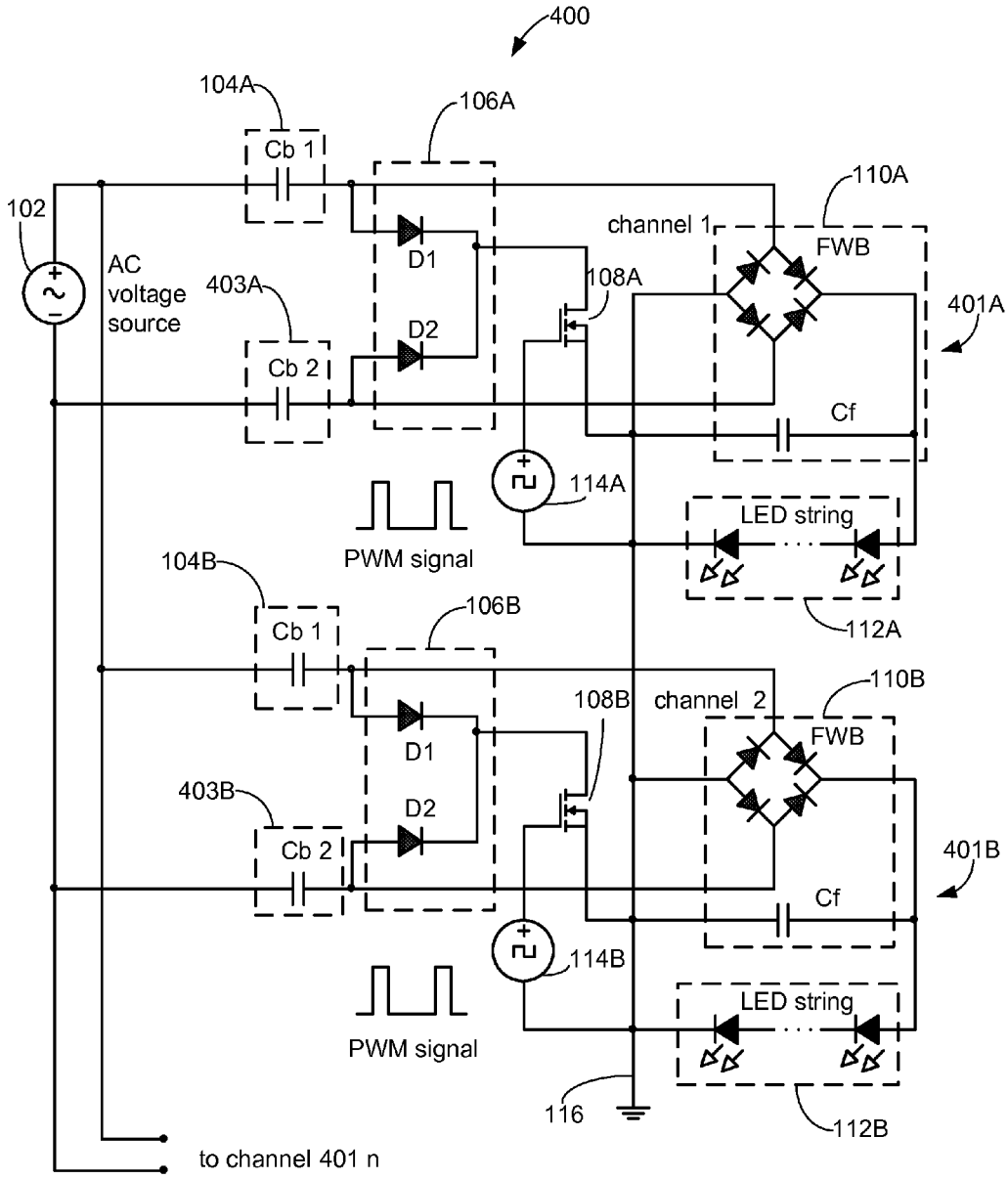
FIG. 4 is a circuit diagram of another exemplary LED driver system consistent with one embodiment of the present disclosure.

FIG. 4 shows a solid state light source driver system 400 according to embodiments described herein. The driver system 400 is configured to drive a plurality of solid state lights source strings, here LED strings 112A, 112B, . . . , 112*n*, from a single AC voltage source, similar to the embodiments shown in FIGS. 2 and 3. The driver system 400 includes a plurality of LED driver circuits 401A, 401B, . . . , 401*n* and an AC voltage source 102 coupled to each of the LED driver circuits 401A, 401B, . . . , 401*n*. Each of the LED driver circuits 401A, 401B, . . . , 401*n* have a similar topology and operate in a similar manner as other LED driver circuits described throughout the specification. Each LED driver circuit 401A, 401B, . . . , 401*n* may include respective current source circuitry 104A, 104B, . . . , 104*n*, a respective switch 108A, 108B, . . . , 108*n*, respective PWM signal source circuitry 114A, 114B, . . . , 114*n*, respective shunt circuitry 106A, 106B, . . . , 106*n*, and respective LED strings 112A, 112B, . . . , 112*n*. Here, the designation A, B, . . . , N in connection with reference numerals should be interpreted as a repetition of like components. The description and operation of these components are described above with reference to FIGS. 1-3.

Each LED driver circuit 401A, 401B, . . . , 401*n* in this embodiment may also include respective isolation circuitry 403A, 403B, . . . , 403*n* coupled to the negative voltage rail of the AC voltage source 102. In some embodiments, the isolation circuitry 403A, 403B, . . . , 403*n* may include a capacitor Cb2. The capacitance value of the capacitor Cb2 may be the same or approximately the same as the ballast capacitor Cb1 (element 104 in FIG. 1) to reduce or eliminate uneven loading of the AC voltage source 102. The isolation circuitry 403A, 403B, . . . , 403*n* is configured to isolate each LED channel from other LED channels. Thus, advantageously, the isolation circuitry 403A, 403B, . . . , 403*n* may reduce or eliminate crosstalk between the channels to enable more precise control over each channel. Also advantageously, the isolation circuitry 403A, 403B, . . . , 403*n* enables each LED driver circuit 401A, 401B, . . . , 401*n* to be coupled to a ground 116, thus eliminating a floating condition in any of the LED driver circuit 401A, 401B, . . . , 401*n*. In other words, the isolation circuitry 403A, 403B, . . . , 403*n* may enable both the PWM signal source circuitry 114A, 114B, . . . , 114*n* and the LED strings 112A, 112B, . . . , 112*n* to be coupled to the ground 116.

As with the embodiments described previously, each LED string 112A, 112B, . . . , 112*n* may include one or more individual LED devices. Each string may be arranged by color, for example a red, green, blue (RGB) topology in which the LED string 112A may include one or more red LEDs, the LED string 112B may include one or more green LEDs, and the LED string 112*n* may include one or more blue LEDs. Of course, this is only an example and other color arrangements are equally contemplated herein, for example, RGW (red, green, white), RGBY (red, green, blue, yellow), infrared, etc., without departing from the scope of embodiments described herein. By controlling the brightness in each LED string 112A, 112B, . . . , 112*n*, the overall brightness and/or perceived color of the collection of the LED strings 112A, 112B, . . . , 112*n* may be controlled. Thus, in such embodiments, each PWM signal source circuitry 114A, 114B, . . . , 114*n* may be independently controlled with its own duty cycle to independently control each LED string 112A, 112B, . . . , 112*n*. To that end, the respective ballast capacitor Cb1 in each respective current source circuitry 104A, 104B, . . . , 104*n*, and the respective isolation capacitor Cb2 in each respective isolation circuitry 403A, 403B, . . . , 403*n*, may operate to reduce or eliminate crosstalk between each LED driver circuit 401A, 401B, . . . , 401*n*, i.e., reduce or eliminate the effect of varying current between LED strings 112A, 112B, . . . , 112*n*.

Figure 5:
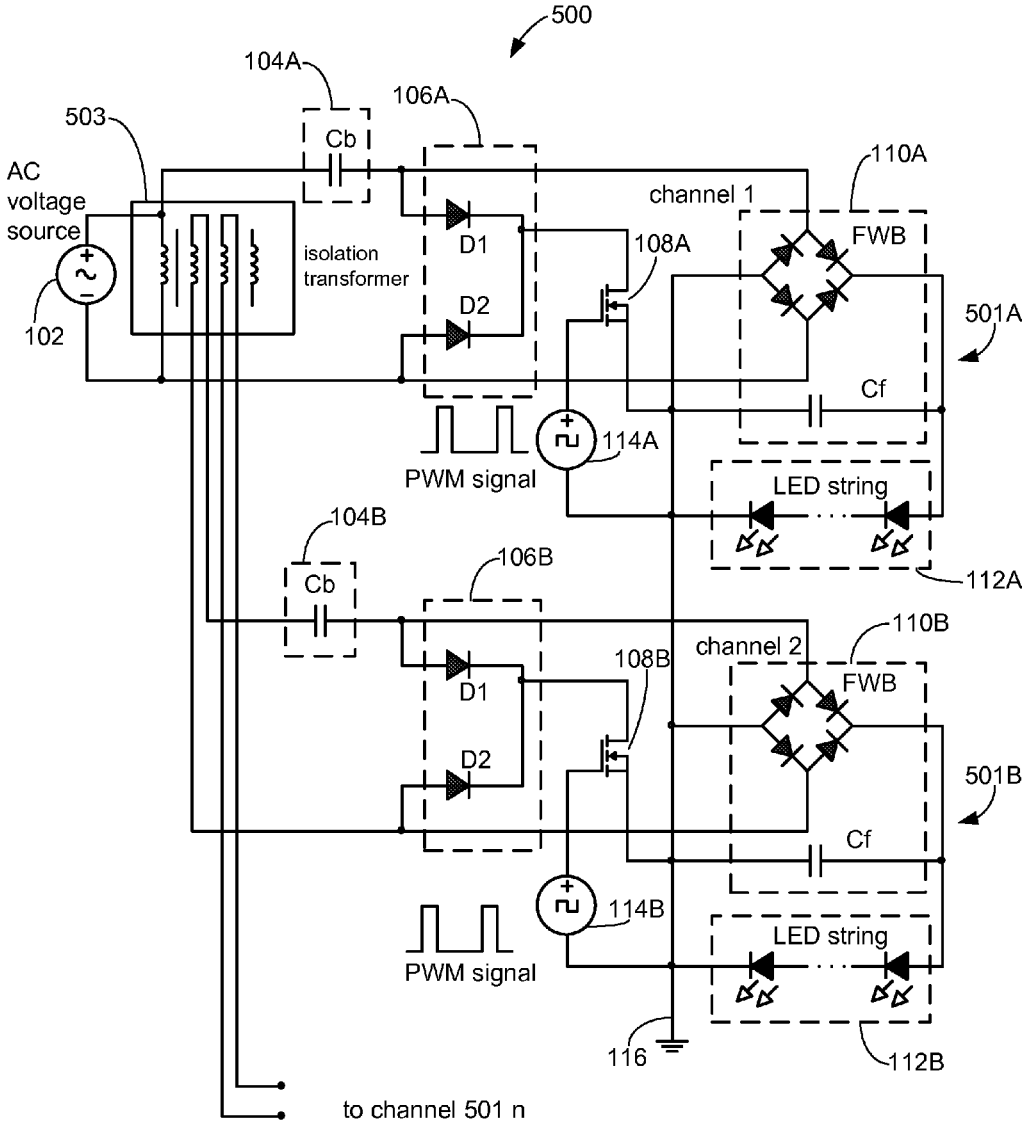
FIG. 5 is a circuit diagram of another exemplary LED driver system consistent with one embodiment of the present disclosure.

FIG. 5 shows a solid state light source driver system 500 according to embodiments described herein. The driver system 500 shown in FIG. 5 is configured to drive a plurality of solid state light sources, here LED strings, from a single AC voltage source, similar to the embodiments of FIGS. 2, 3 and 4. The driver system 500 includes a plurality of LED driver circuits 501A, 501B, . . . , 501*n* and an AC voltage source 102 coupled to each of the LED driver circuits 501A, 501B, . . . , 501*n*. Each of the LED driver circuits 501A, 501B, . . . , 501*n* have a similar topology and operate in a similar manner as those described throughout. Each LED driver circuit 501A, 501B, . . . , 501*n* may include respective current source circuitry 104A, 104B, . . . , 104*n*, a respective switch 108A, 108B, . . . , 108*n*, respective PWM signal source circuitry 114A, 114B, . . . , 114*n*, respective shunt circuitry 106A, 106B, . . . , 106*n*, respective rectifier circuitry 110A, 110B, . . . , 110*n* and respective LED strings 112A, 112B, . . . , 112*n*. Here, the designation A, B, . . . , N in connection with reference numerals should be interpreted as a repetition of like components. The description and operation of these components are described above with reference to FIGS. 1-4.

The driver system 500 may also include an isolation transformer 503 coupled between the AC voltage source 102 and each of the LED driver circuits 501A, 501B, . . . , 501*n*. The isolation transformer 503 may be configured to supply each LED driver circuit 501A, 501B, . . . , 501*n* with an AC voltage and to isolate each LED driver circuit 501A, 501B, . . . , 501*n* from other driver circuits. The isolation transformer 503 may be, and in some embodiments is, a known isolation transformers of any type; such transformers are generally configured with a primary winding and a plurality of isolated secondary windings. The turn ration between the primary and secondary side may determine the voltage delivered by the isolation transformer 503. Thus, advantageously, the isolation transformer 503 may reduce or eliminate crosstalk between the channels to enable more precise control over each channel. Also advantageously, the isolation transformer 503 may enable each LED driver circuit 501A, 501B, . . . , 501*n* to be coupled to a ground 116, thus eliminating a floating condition in any of the LED driver circuits 501A, 501B, . . . , 501*n*. In other words, the isolation transformer 503 may enable both the PWM signal source circuitry 114A, 114B, . . . , 114*n* and the LED strings 112A, 112B, . . . 112*n* to be coupled to the ground 116.

As with other embodiments, each LED string 112A, 112B, . . . , 112*n* may include one or more individual LED devices. Each string may be arranged by color, for example a red, green, blue (RGB) topology in which the LED string 112A may include one or more red LEDs, the LED string 112B may include one or more green LEDs, and the LED string 112*n* may include one or more blue LEDs. Of course, this is only an example and other color arrangements are equally contemplated herein, for example, RGW (red, green, white), RGBY (red, green, blue, yellow), infrared, etc., without departing from the scope of embodiments described herein. By controlling the brightness in each LED string 112A, 112B, . . . , 112*n*, the overall brightness and/or perceived color of the collection of LED strings 112A, 112B, . . . , 112*n* may be controlled. Thus, in such embodiments, each PWM signal source circuitry 114A, 114B, . . . , 114*n* may be independently controlled with its own duty cycle to independently control each LED string 112A, 112B, . . . , 112*n*.

In any of the embodiments described herein, a feedback controller (not shown in any of FIGS. 1-5) may be utilized to provide feedback current control over the LED strings 112 and/or 112A, 112B, . . . , 112*n*. For example, each LED driver circuit may include a feedback sense resistor coupled to the LED strings to generate a current feedback signal to a feedback controller. Alternatively, a photodetector may be disposed near the LED strings to receive light and generate a feedback signal proportional to the light of the LED strings. A feedback controller may be utilized to compare the feedback signal to user-defined and/or preset values to generate control signals to control the duty cycle of the PWM signal generated by the PWM signal source circuitry. Known feedback controllers, in accordance with the teachings of the present disclosure, may be used to control the duty cycle of power delivered to each LED string.

As used in any embodiment herein, "circuit" or "circuitry" may comprise, for example, singly or in any combination, hardwired circuitry, programmable circuitry, state machine circuitry, and/or firmware that stores instructions executed by programmable circuitry. In at least one embodiment, the circuits and/or circuitry described herein may collectively or individually comprise one or more integrated circuits. An "integrated circuit" may include a digital, analog or mixed-signal semiconductor device and/or microelectronic device, such as, for example, but not limited to, a semiconductor integrated circuit chip.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" or "an" to modify a noun may be understood to be used for convenience and to include one, or more than one, of the modified noun, unless otherwise specifically stated.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

What is claimed is:

1. A solid state light source driving and dimming system, comprising:

a plurality of solid state light source driver circuits configured to be coupled to an AC voltage source, each driver circuit comprising:

a constant current circuitry coupled to the AC voltage source, wherein the constant current circuitry is configured to generate a constant AC current from the AC voltage source;

rectifier circuitry coupled to the constant current circuitry and configured to generate a DC current to drive at least one solid state light source;

shunt circuitry coupled to a negative voltage rail and a positive voltage rail of the AC voltage source;

switch circuitry coupled to the shunt circuitry; and pulse width modulation (PWM) circuitry configured to generate a PWM signal to control a conduction state of the switch circuitry;

wherein when the switch circuitry is closed, a conduction path exists between the AC voltage source and the shunt circuitry through the switch circuitry to discontinue the DC current, and when the switch circuitry is closed, the shunt circuitry is electrically decoupled from the AC voltage source.

2. The solid state light source driving and dimming system of claim 1, wherein the constant current circuitry comprises a ballast capacitor coupled to the positive rail of the AC voltage source.

3. The solid state light source driving and dimming system of claim 1, wherein the shunt circuitry comprises:

a first diode coupled to the positive voltage rail and in forward bias toward the switch; and a second diode coupled to the negative voltage rail and in forward bias toward the switch;

wherein when the switch is closed, the AC voltage source is shunted through the first and second diodes to discontinue the DC current to the at least one solid state light source.

4. The solid state light source driving and dimming system of claim 1, wherein the shunt circuitry comprises:

a first diode coupled to the negative voltage rail and in forward bias toward the positive voltage rail;

a second diode coupled to the first diode and the positive voltage rail and in forward bias toward the switch; and a third diode coupled to the negative voltage rail and in forward bias toward the switch;

wherein when the switch is closed, the AC voltage source is shunted through the first, second and third diodes to discontinue the DC current to the at least one solid state light source.

5. The solid state light source driving and dimming system of claim 1, wherein the rectifier circuitry comprises full wave bridge rectifier circuitry configured to generate a full wave rectified AC current from the AC current and a filtering capacitor in parallel with the at least one solid state light source; and wherein the filtering capacitor is configured to filter the full wave rectified AC current into the DC current to drive the at least one solid state light source.

6. The solid state light source driving and dimming system of claim 1, wherein the rectifier circuitry comprises three diodes configured to generate a rectified AC current from the AC current and a filtering capacitor in parallel with the at least one solid state light source; and wherein the filtering capacitor is configured to filter the rectified AC current into the DC current to drive the at least one solid state light source.

7. The solid state light source driving and dimming system of claim 1, further comprising:

a return diode shared by the driver circuits, wherein the return diode is coupled to the switch and the shunt circuitry and in forward bias toward the negative voltage rail; wherein when the switch is closed, the return diode provides a current path from the positive voltage rail, through the shunt circuitry and the switch and to the negative voltage rail.

8. The solid state light source driving and dimming system of claim 1, further comprising:

first and second return diodes shared by the driver circuits, wherein the first return diode is coupled to the switch and the shunt circuitry and in forward bias toward the negative voltage rail, and the second return diode is coupled to the rectifier circuitry and the solid state light source and in forward bias toward the negative voltage rail;

wherein when the switch is closed, the first return diode provides a current path from the positive voltage rail, through the shunt circuitry and the switch and to the negative voltage rail, and wherein when the switch is opened, the second return diode provides a current path from the solid state light source to the negative voltage rail.

9. The solid state light source driving and dimming system of claim 1, wherein the switch circuitry and the PWM circuitry are coupled to a common ground.

10. The solid state light source driving and dimming system of claim 1, wherein the rectifier circuitry and the at least one solid state light source are coupled to a common ground.

11. The solid state light source driving and dimming system of claim 1, wherein the switch circuitry, the PWM circuitry, the rectifier circuitry and the at least one solid state light source are coupled to a common ground.

12. The solid state light source driving and dimming system of claim 1, wherein each driver circuit further comprises isolation circuitry coupled to a negative voltage rail of the AC current source and configured to electrically isolate each driver circuit from each other.

13. The solid state light source driving and dimming system of claim 1, further comprising:

an isolation transformer having a primary winding and a plurality of secondary windings, wherein the primary winding is coupled to the AC voltage source and each driver circuit is coupled to a respective secondary winding, and wherein the isolation transformer is configured to electrically isolate each driver circuit from each other.

14. A solid state light source driving and dimming system, comprising:

a plurality of solid state light source driver circuits configured to be coupled to an AC voltage source, each driver circuit comprising:

constant current circuitry coupled to an AC voltage source, the constant current circuitry is configured to generate a constant AC current from the AC voltage source;

isolation circuitry coupled to the AC voltage source and configured to electrically isolate each driver circuit from each other;

rectifier circuitry coupled to the constant current circuitry and configured to generate a DC current to drive at least one solid state light source;

shunt circuitry coupled to a negative and positive voltage rails of the AC voltage source;

switch circuitry coupled to the shunt circuitry; and pulse width modulation (PWM) circuitry configured to generate a PWM signal to control a conduction state of the switch circuitry;

wherein when the switch circuitry is closed, a conduction path exists between the AC voltage source and the shunt circuitry through the switch circuitry to discontinue the DC current, and when the switch circuitry is closed, the shunt circuitry is electrically decoupled from the AC voltage source.

15. The solid state light source driving and dimming system of claim 14, wherein the shunt circuitry comprises:

a first diode coupled to the negative voltage rail and in forward bias toward the positive voltage rail;

a second diode coupled to the first diode and the positive voltage rail and in forward bias toward the switch; and a third diode coupled to the negative voltage rail and in forward bias toward the switch;

wherein when the switch is closed, the AC voltage source is shunted through the first, second and third diodes to discontinue the DC current to the at least one solid state light source.

16. The solid state light source driving and dimming system of claim 14, wherein the isolation circuitry comprises a capacitor coupled to the negative voltage rail and the constant current circuitry comprises a capacitor coupled to the positive voltage rail, and wherein the capacitance of the isolation circuitry and the constant current circuitry are approximately equal.

17. The solid state light source driving and dimming system of claim 14, wherein the switch circuitry, the PWM circuitry, the rectifier circuitry and the at least one solid state light source are coupled to a common ground.

18. A solid state light source driving and dimming system, comprising:

an isolation transformer having a primary winding coupled to an AC voltage source and a plurality of secondary windings, wherein the isolation transformer is configured to electrically isolate each respective secondary winding from each other;

a plurality of solid state light source driver circuits configured to be coupled to a respective secondary winding, each driver circuit comprising:

constant current circuitry coupled to a secondary winding, the constant current circuitry is configured to generate a constant AC current from the AC voltage source;

rectifier circuitry coupled to the constant current circuitry and configured to generate a DC current to drive at least one solid state light source;

shunt circuitry coupled to a negative and positive voltage rails of the secondary winding;

switch circuitry coupled to the shunt circuitry; and pulse width modulation (PWM) circuitry configured to generate a PWM signal to control a conduction state of the switch circuitry;

wherein when the switch circuitry is closed, a conduction path exists between the secondary winding and the shunt circuitry through the switch circuitry to discontinue the DC current, and when the switch circuitry is closed, the shunt circuitry is electrically decoupled from the secondary winding.

19. The solid state light source driving and dimming system of claim 18, wherein the shunt circuitry comprises:

a first diode coupled to the negative voltage rail and in forward bias toward the positive voltage rail;

a second diode coupled to the first diode and the positive voltage rail and in forward bias toward the switch; and a third diode coupled to the negative voltage rail and in forward bias toward the switch;

wherein when the switch is closed the secondary winding is shunted through the first, second and third diodes to discontinue the DC current to the at least one solid state light source.

20. The solid state light source driving and dimming system of claim 18, wherein the switch circuitry, the PWM circuitry, the rectifier circuitry and the at least one solid state light source are coupled to a common ground.

* * * * *